US008054318B2

(12) United States Patent
Ok et al.

(10) Patent No.: US 8,054,318 B2
(45) Date of Patent: Nov. 8, 2011

(54) IMAGE DISPLAY DEVICE AND A METHOD FOR ADJUSTING COLOR THEREOF

(75) Inventors: Hyun-wook Ok, Goyang-si (KR); Du-sik Park, Suwon-si (KR); Young-shin Kwak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 896 days.

(21) Appl. No.: 11/340,487

(22) Filed: Jan. 27, 2006

(65) Prior Publication Data

US 2006/0170701 A1 Aug. 3, 2006

(30) Foreign Application Priority Data

Jan. 28, 2005 (KR) ..... 10-2005-0008070

(51) Int. Cl.
*G09G 5/02* (2006.01)

(52) U.S. Cl. ..... 345/601; 345/600; 345/602; 345/604; 358/501; 358/519; 358/523; 358/528; 382/162; 382/163; 382/167; 382/300

(58) Field of Classification Search ..... 345/589–606, 345/419; 382/162, 163, 167, 300; 358/528.523, 358/501, 519

See application file for complete search history.

(56) References Cited

U.S. PATENT DOCUMENTS 5,202,935 A * 4/1993 Kanamori et al. ..... 382/162
5,600,764 A * 2/1997 Kakutani ..... 345/591
5,801,855 A * 9/1998 Ohta ..... 358/518
6,876,445 B2 * 4/2005 Shibuya et al. ..... 356/237.2
7,084,968 B2 * 8/2006 Shibuya et al. ..... 356/237.2
7,136,523 B2 * 11/2006 Fukao et al. ..... 382/167
7,339,700 B2 * 3/2008 Ohga et al. ..... 358/1.9
7,345,787 B2 * 3/2008 Ito et al. ..... 358/1.9
7,450,267 B2 * 11/2008 Ito et al. ..... 358/1.9
2002/0075278 A1 * 6/2002 Kakutani ..... 345/600
2002/0181018 A1 * 12/2002 Hung ..... 358/1.15
2003/0081831 A1 * 5/2003 Fukao et al. ..... 382/167
2003/0158828 A1 * 8/2003 Ikeda et al. ..... 706/12
2004/0239969 A1 * 12/2004 Shoda et al. ..... 358/1.9
2004/0263882 A1 * 12/2004 Ito et al. ..... 358/1.9
2005/0219260 A1 * 10/2005 Satomi et al. ..... 345/604
2005/0285871 A1 * 12/2005 Tsujiguchi ..... 345/565

FOREIGN PATENT DOCUMENTS

JP 2000083176 A 3/2000

* cited by examiner

*Primary Examiner* — Xiao Wu
*Assistant Examiner* — Abderrahim Merouan
(74) *Attorney, Agent, or Firm* — Sughrue Mion, PLLC

(57) ABSTRACT

An image displaying device and a method for controlling color thereof. The image displaying device includes a lattice selection unit which selects a lattice of a look-up table (LUT) for reference of each pixel of an input image, a lattice control unit which determines whether the selected lattice requires to be changed for color adjustment and calculates a change degree of the lattice, an LUT conversion unit which converts the LUT by changing the lattice based on the calculated change degree, and a lattice reference/interpolation unit which refers to or interpolates the lattice based on the converted LUT. Accordingly, the LUT can be updated real time, thereby realizing more accurate adjustment of color.

10 Claims, 7 Drawing Sheets

IMAGE DISPLAY DEVICE AND A METHOD FOR ADJUSTING COLOR THEREOF

CROSS-REFERENCE TO RELATED APPLICATIONS

This application claims benefit under 35 U.S.C. §119(a) of Korean Patent Application No. 2005-08070, filed Jan. 28, 2005, the entire contents of which are incorporated herein by reference.

BACKGROUND OF THE INVENTION

1. Field of the Invention

The present invention relates to an image display device and a method for adjusting color thereof. More particularly, the present invention relates to an image display device capable of adjusting color as demanded by a user by updating real time a look-up table.

2. Description of the Related Art

As digital electronic engineering develops, conventional analog data has been replaced by digital data and accordingly, technologies for processing versatile digital image data have been introduced in order for effective processing of a great amount of data.

Standardization has appeared according to introduction of such versatile digital image processing technologies. Through the standardization, the digital image processing technologies can be widely in computer and communication industries, including applications such as a video conference system, a digital broadcasting codec system and a picture phone technology.

For example, a digital image compression technology, which is to store information onto an optical disc such as compact disc-read only memory (CD-ROM) or other digital storage medium, has the nearly same basis as a compression technology for visible communication.

Image signals according to the conventional art are processed in a three-dimension color space represented by red (R), green (G) and blue (B) and displayed through light sources of the three colors. Since R, G and B are the three primary colors constituting all colors, the image signals can be expressed using color signals of the three colors.

Most of recently-introduced image displaying devices have capability of expressing respective colors differently from input color signals. Even in one device, colors may be reproduced a little bit differently.

FIG. 1 shows color coordinates suggested by a high-definition television (HDTV) and color coordinates representable through an image displaying device.

Referring to FIG. 1, the color coordinates (RGB) A suggested by a high definition television (HDTV) standard, color coordinates B of a currently marketed liquid crystal display (LCD) TV, and color coordinates C of a digital lighting processing (DLP) have all different forms from one another.

In other words, a color space (a space corresponding to the color coordinates suggested by the HDTV standard) of signals input to the image displaying device and a color space (a space corresponding to the color coordinates of currently-marketed various TVs) representable by the image displaying device are different from each other.

In order to overcome such a problem that the input color signals are displayed on the image displaying device in different colors, various methods for compensating the color difference have been suggested. One of the methods uses a three-dimension look-up table (LUT) for more correct reproduction of colors.

The technique using the LUT realizes high accuracy but is difficult to update in real time. Therefore, the LUT is used only for color compensation while other techniques having relatively lower accuracy are utilized together with the LUT to adjust colors real time.

A converter which converts an LUT real time is disclosed in Japanese Patent Laid-open No. 2000-083176. In this converter, an already decided color compensation LUT for converting colors and at least one LUT preset by a user are integrated. However, conversion of the LUT is dependent upon the number of the already decided LUTs. In addition, the above converter requires a dedicated memory for storing the LUTs.

As a result, a method capable of accurately adjusting the colors real time using only the LUT technique but not requiring a dedicated hardware structure.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

According to an aspect of the present invention, there is provided an image displaying device capable of adjusting color as demanded by a user by determining lattices that requires change for color adjustment and updating an LUT in real time through controlling the lattices, and a method for the same.

According to an aspect of the present invention, there is provided an image displaying device comprising a lattice selection unit selecting a lattice of an LUT for reference of each pixel of an input image, a lattice control unit determining whether the selected lattice requires to be changed for color adjustment and calculating a change degree of the lattice, an LUT conversion unit converting the LUT by changing the lattice based on the calculated change degree, and a lattice reference/interpolation unit referring to or interpolating the lattice based on the converted LUT.

Solid colors for lattices of the LUT may comprise red, green, blue, cyan, magenta and yellow. In order to adjust one of the solid colors, the lattice control unit determines a lattice disposed between two solid colors neighboring the to-be-adjusted solid color as a lattice requiring change.

In order to adjust a middle color between two of the solid colors, the lattice control unit determines a lattice to be changed, using proportion relations between the solid colors. The to-be-changed lattice is the lattice corresponding to a position value obtained by subtracting a position value of the middle color from position values of the solid colors disposed respectively outside of the two solid colors.

The lattice control unit calculates the change degree within a range between the to-be-changed lattice and the neighboring lattices.

The image displaying device further comprise a user input unit to be input with a color requiring change by a user.

According to another aspect of the present invention, there is provided a method for controlling color in an image displaying device, comprising selecting a lattice in an LUT for reference of each pixel of an input image; determining whether the selected lattice requires to be changed for color adjustment; when the selected lattice is determined to be the lattice requiring change for color adjustment calculating a change degree of the lattice; converting the LUT by changing the lattice based on the calculated change degree; and a lattice reference/interpolation unit referring to or interpolating the lattice based on the converted LUT.

In the determining operation, in order to adjust one of the solid colors, a lattice disposed between two solid colors neighboring the to-be-adjusted solid color is determined as a lattice requiring change.

Solid colors for lattices of the LUT comprise red, green, blue, cyan, magenta and yellow.

In the determining operation, in order to adjust one of the solid colors, a lattice disposed between two solid colors neighboring the to-be-adjusted solid color is determined as a lattice requiring change.

In the determining operation, in order to adjust a middle color between two of the solid colors, a lattice to be changed is determined using proportion relations between the solid colors.

The to-be-changed lattice is the lattice corresponding to a position value obtained by subtracting a position value of the middle color from position values of the solid colors disposed respectively outside of the two solid colors.

The calculating operation calculates the change degree within a range between the to-be-changed lattice and the neighboring lattices.

The method may further comprise being inputting with a color requiring change by a user and determining whether a lattice corresponding to the input color is to be changed.

BRIEF DESCRIPTION OF THE DRAWING FIGURES

The above and/or other aspects of the present invention will become more apparent by describing in detail exemplary embodiments thereof with reference to the attached drawing figures, wherein.

DETAILED DESCRIPTION OF THE EXEMPLARY EMBODIMENTS

Hereinafter, certain exemplary embodiments of the present invention will be described in detail with reference to the accompanying drawing figures.

The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 1:
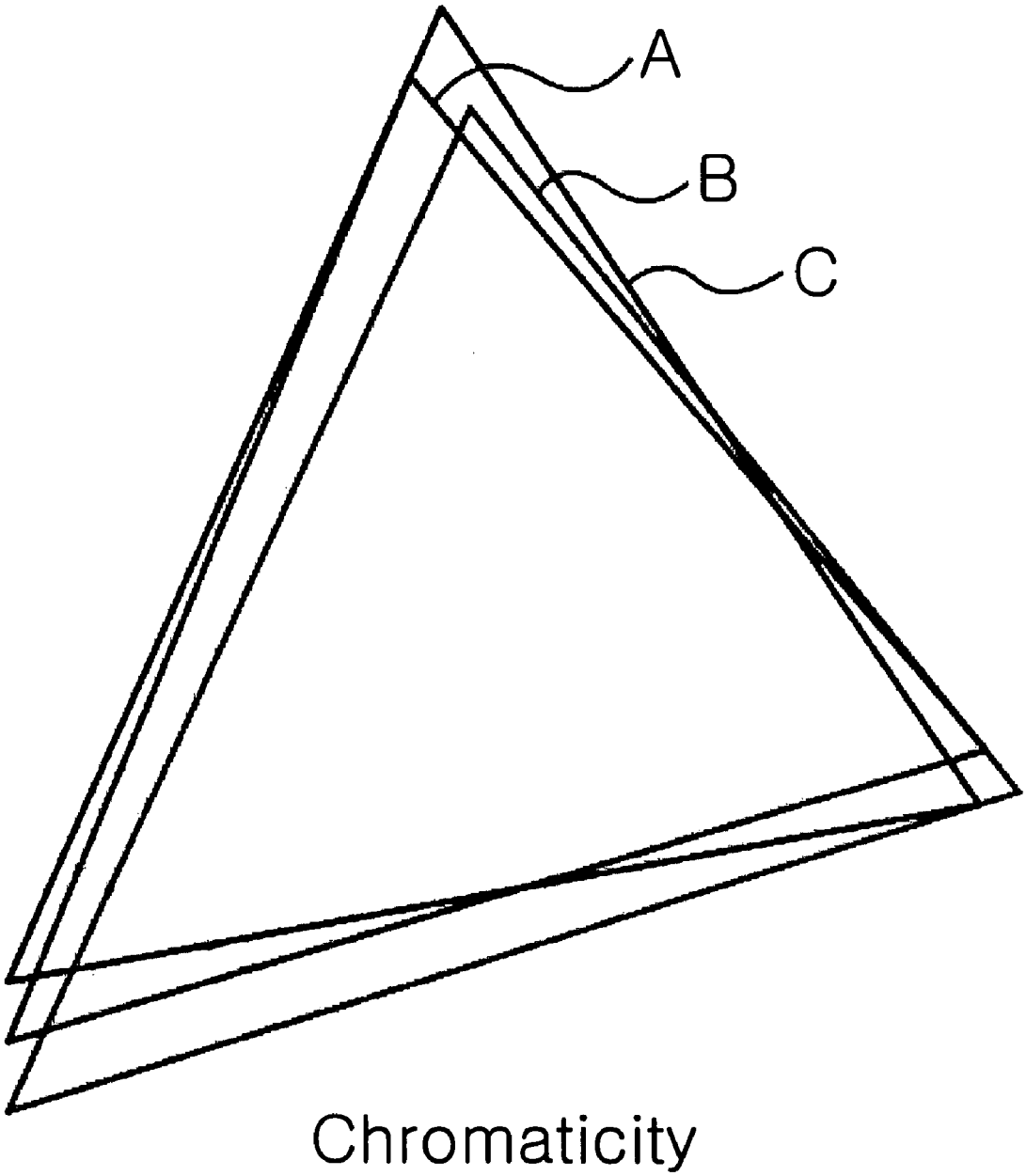
FIG. 1 (PRIOR ART)
FIG. 1 shows color coordinates suggested in HDTV and color coordinates representable by an image displaying device.
Figure 2:
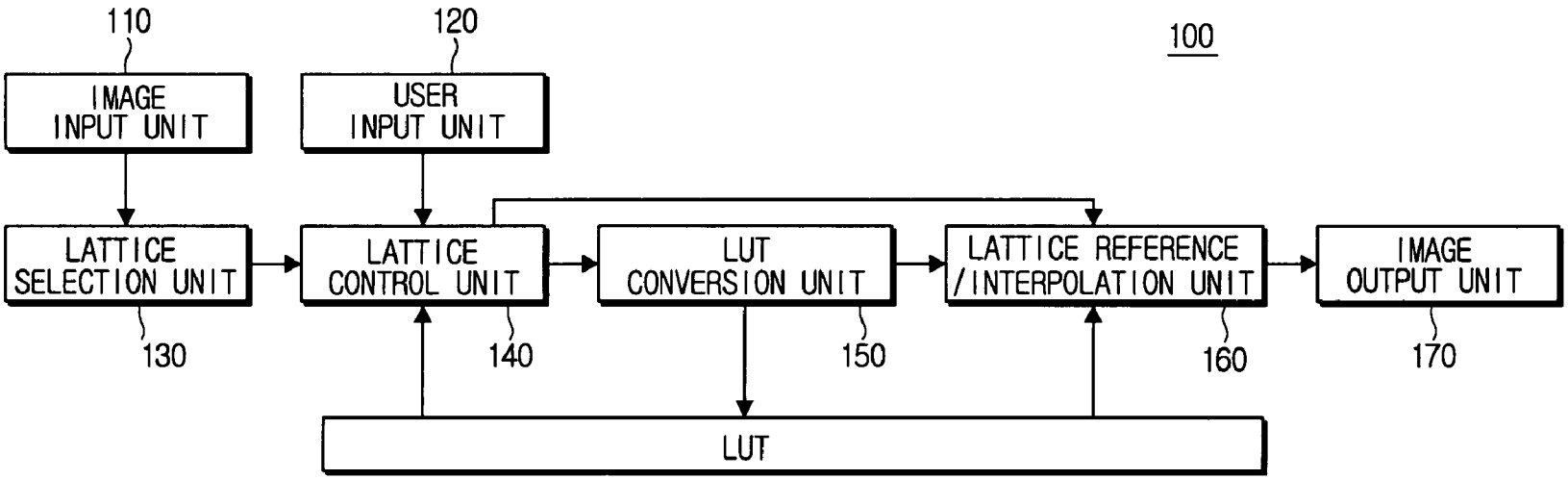
FIG. 2 is a block diagram of an image displaying device according to an exemplary embodiment of the present invention.

FIG. 2 is a block diagram of an image displaying device according to an exemplary embodiment of the present invention.

A look-up table (LUT) is a reference table for mapping input colors into a predetermined color space. Generally, the LUT is formed by designating lattice points by packing the color space and tabulating data with respect to the color corresponding to the designated lattice points. Solid colors designated for the lattice of the LUT include red, green, blue, cyan, magenta and yellow.

An image displaying device 100 according to an exemplary embodiment of the present invention comprises an image input unit 110, a user input unit 120, a lattice selection unit 130, a lattice control unit 140, an LUT conversion unit 150, a lattice reference/interpolation unit 160, and an image output unit 170.

The image input unit 110 is input with an image from a predetermined image source and supplies the image to the lattice selection unit 130. The image source may comprise a computer, a broadcast-receiver antenna, a hard disc drive (HDD), a digital versatile disc (DVD) player, a video cassette recorder (VCR), and a set top box.

The user input unit 120 provides an interface between the image displaying device 100 and a user. The user input unit 120 of this exemplary embodiment is input with a color for adjustment by a user and supplies the color to the lattice control unit 140.

The lattice selection unit 130 selects a lattice of the LUT for reference of respective pixels in the image input through the image input unit 110. When the LUT comprises 5×5×5 points, the lattice selection unit 130 selects 4 or 8 lattices for interpolation operation.

The lattice control unit 140 determines whether the lattices selected by the lattice selection unit 130 require to be changed for color adjustment and if so, calculates a change degree of the lattices. Here, the change degree is calculated within a range between lattices neighboring the to-be-changed lattice.

Additionally, upon the user's input through the user input unit 120, the lattice control unit 140 determines whether the lattice corresponding to the colors as input by the user is the lattice requiring color adjustment and if so, calculates the change degree.

A method that the lattice control unit 140 determines whether the lattice selected by the lattice selection unit 130 requires change for color adjustment will be described. When adjusting one of the solid colors, the lattice control unit 140 determines a lattice disposed between two solid colors neighboring the to-be-adjusted color as a lattice requiring change.

In order to adjust a middle color between two of the solid colors, the lattice control unit 140 determines a lattice to be changed, using proportion relations between the solid colors. The to-be-changed lattice, herein, is the lattice corresponding to a position value obtained by subtracting a position value of the middle color from position values of the solid colors disposed respectively outside of the two solid colors.

The method of determining whether the lattice selected by the lattice selection unit 130 will be described hereinafter more specifically with reference to FIG. 4.

The LUT conversion unit 150 converts the LUT by changing the lattice by the change degree calculated by the lattice control unit 140. Accordingly, the LUT can be updated real time by the LUT conversion unit 150. The method for changing the lattice by the LUT conversion unit 150 will be described in greater detail with reference to FIGS. 5 and 6.

The lattice reference/interpolation part 160 refers to and interpolates the lattice using the LUT converted through the LUT conversion unit 150.

The image output unit 170 outputs the image interpolated by the LUT updated through the lattice reference/interpolation unit 160. The image is displayed through the image output unit 170 and thereby supplied to the user.

Figure 3A:
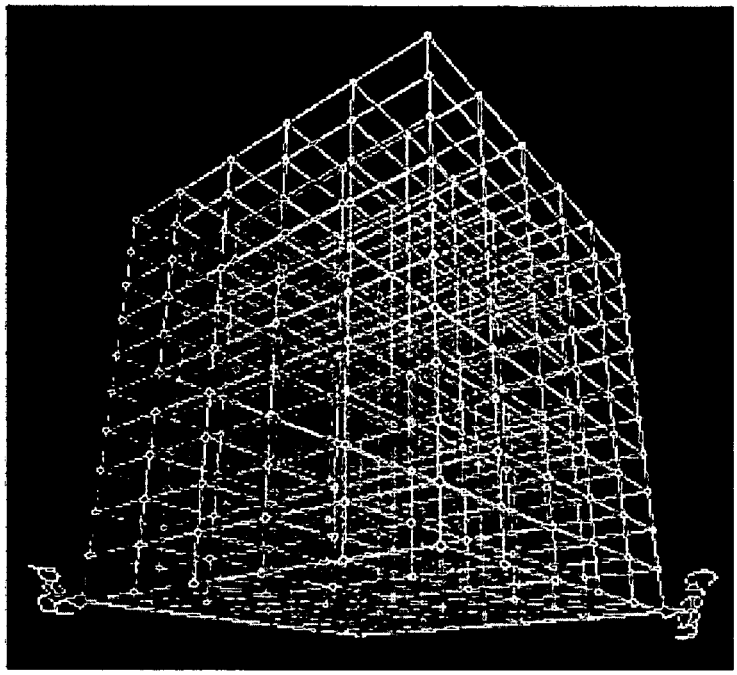
FIGS. 3A and 3B show lattices in a RGB color space and in a CIEL*a*b* color space.
Figure 3B:
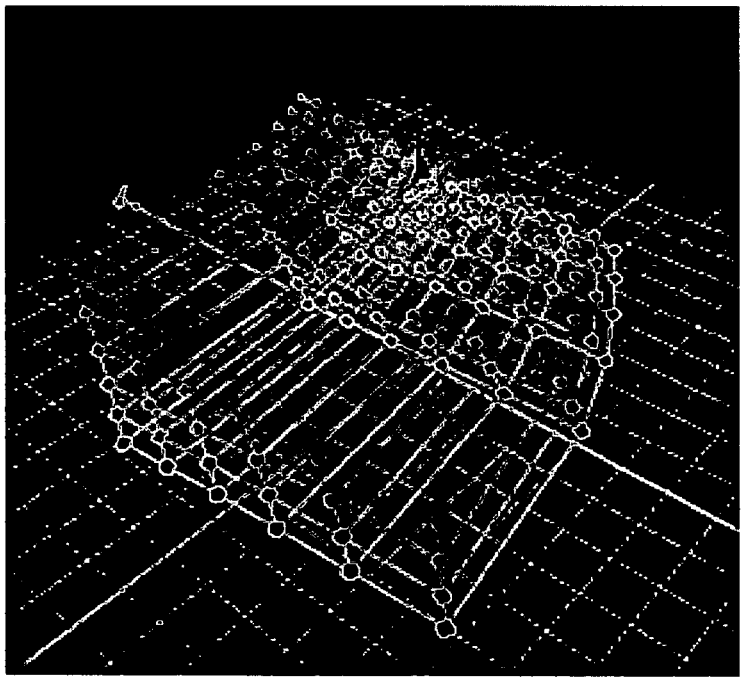

FIGS. 3A to 3B show lattices in a red-green-blue (RGB) color space and a CIEL*a*b* color space. FIG. 3A illustrates the structure of a lattice in the RGB color space, and FIG. 3B illustrates the structure of a lattice in the CIEL*a*b* color space corresponding to FIG. 3A.

As shown in FIGS. 3A and 3B, the lattices in the RGB color space are arranged in regular intervals, whereas the lattices in the CIEL*a*b* color space are arranged in irregular intervals.

Although the intervals of the lattices in the RGB color space and the CIEL*a*b* color space are different, the arrangement characteristics of the lattices do not change. This infers that movements of the lattices in the RGB color space and in the CIEL*a*b* color space are similar with each other. Therefore, in the present exemplary embodiment, the change degree of the lattice can be calculated by the lattice control unit 140 by considering just the neighboring lattices of one lattice.

Figure 4:
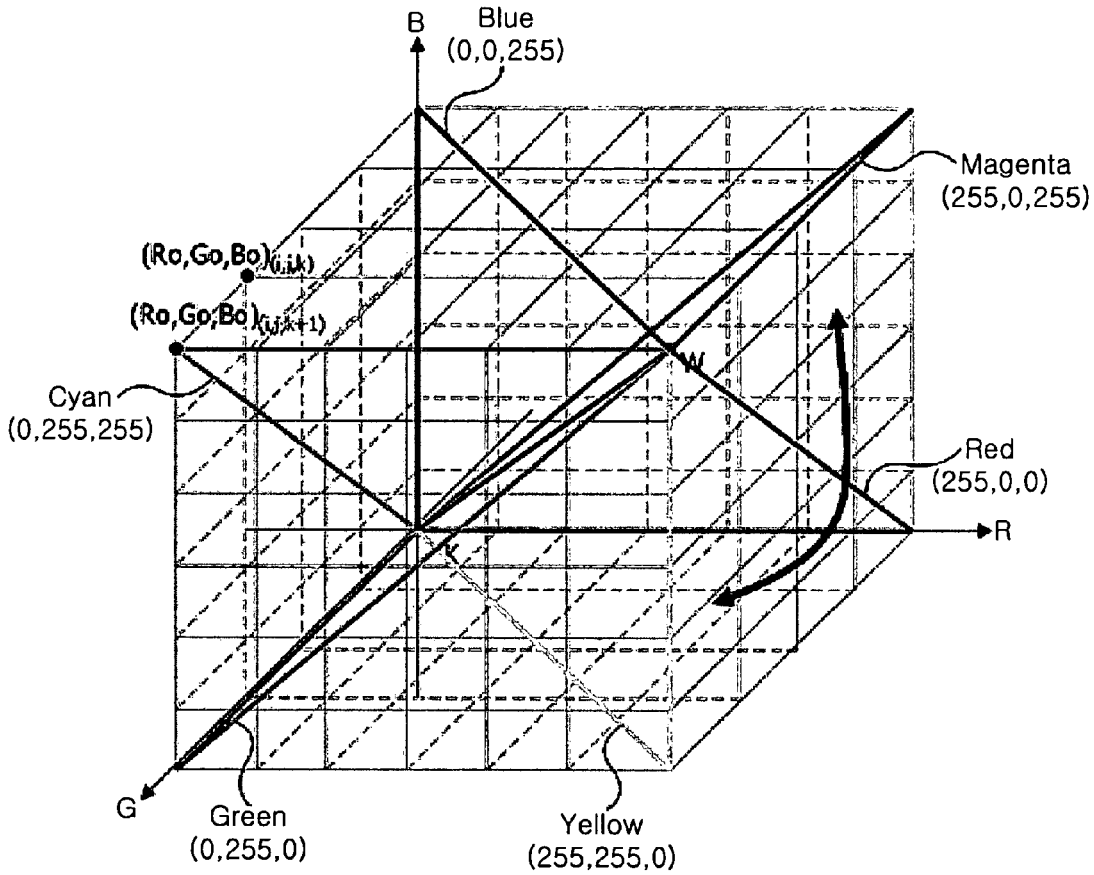
FIG. 4 is a view for explaining a lattice which requires to be changed for color adjustment.

FIG. 4 illustrates the lattice to be changed for color adjustment.

In FIG. 4, the solid colors designated as the lattices of the LUT are illustrated in the RGB color space. In this exemplary embodiment, the solid colors designated as the lattices of the LUT are red, green, blue, cyan, magenta and yellow. Position values of the solid colors are as follows: Red (255, 0, 0), Green (0, 255, 0), Blue (0, 0, 255), Cyan (0, 255, 255), Magenta (255, 0, 255) and Yellow (255, 255, 0).

As illustrated, since the six solid colors in the RGB color space all form the same angle with one another, the lattice control unit 140 can determine whether the lattice selected by the lattice selection unit 130 requires to be changed for color adjustment using the proportion relations among the six solid colors.

In order to adjust one of the six solid colors, for example, when adjusting red, since a red plane (255, 0, 0) is disposed between a yellow plane (255, 255, 0) and a magenta plane (255, 0, 255), the lattice selection unit 130 determines the lattice disposed between the yellow plane (255, 255, 0) and the magenta plane (255, 0, 255) to be the lattice requiring change for color adjustment.

In FIG. 4, a lattice area determined by the lattice selection unit 130 to be the lattice requiring change for color adjustment is illustrated by an arrow. As indicated by the arrow, the area of the to-be-changed lattice belongs to a magenta plane (255, 0, 255) to a yellow plane (255, 255, 0).

When adjusting the middle color between two of the six solid colors, for example, red and yellow, the position value of the middle color for adjustment is presumed as 100(255, 100, 0).

In this case, the lattice control unit 140 determines as the lattice requiring change for color adjustment the lattice corresponding to a position value obtained by subtracting a position value (255, 100, 0) of the middle color from position values (255, 0, 255) and (0, 255, 0) of the magenta plane and the green plane, respectively.

In other words, the lattice control unit 140 determines the lattice, which is disposed between a plane (255, 0, 255-100) that is disposed on 100 between the magenta plane (255, 100, 0) and the red plane (255, 0, 0) and a plane (255, 255-100, 0) that is disposed on 100 between the yellow plane (255, 255, 0) and the green plane (0, 255, 0), to be the lattice requiring change for color adjustment.

As a result of practical calculation, the area of the to-be-changed lattice is determined to be in a range between (255, 0, 155) and (255, 155, 0).

Figure 5:
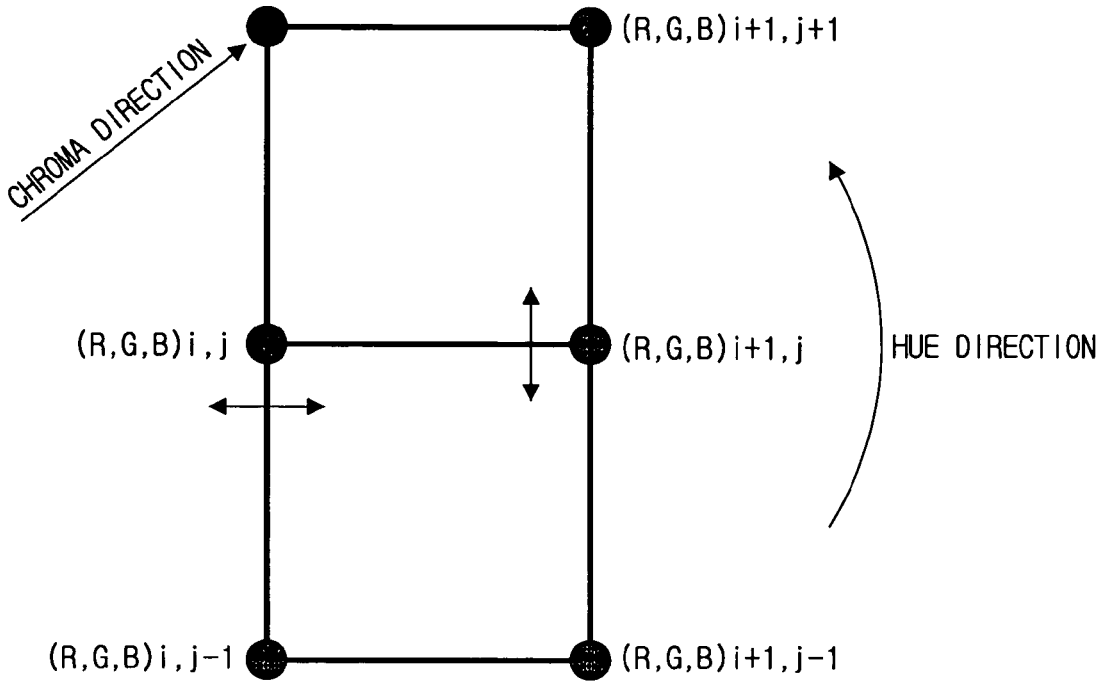
FIG. 5 illustrates a first exemplary embodiment of a method for changing lattice.

FIG. 5 illustrates a first exemplary embodiment of a method for changing the lattice.

As described with reference to FIGS. 3A to 3B, although the lattices are arranged in different manners in the RGB color space and in the CIEL*a*b* color space, the arrangement characteristics do not change. Therefore, by analyzing the lattice in the RGB color space into the lattice in the CIEL*a*b*, hue and chroma can be controlled, maintaining the characteristic of the lattice.

Supposing that an area consisting of shaded lattice points in FIG. 5 is determined by the lattice control unit 140 as the to-be-changed lattice for color adjustment, an exemplary embodiment of the method for moving the lattice in directions of hue and chroma will be described with reference to FIG. 5.

In the hue direction, a lattice (i+1, j) is moved along a line connected with a lattice (i+1, j+1) or with a lattice (i+1, j−1). In the chroma direction, a lattice (i+1, j) is moved toward a lattice (i, j). A lattice value herein may be reassigned by interpolating lattice values assigned to neighboring lattices.

Figure 6:
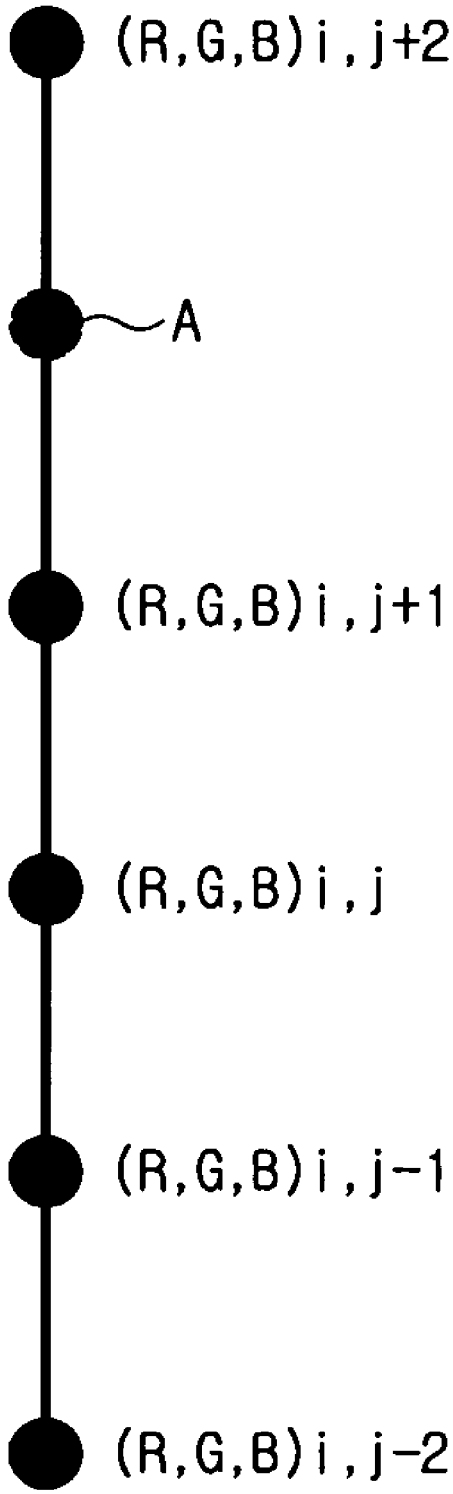
FIG. 6 illustrates a second exemplary embodiment a method for changing lattice.

FIG. 6 illustrates a second exemplary embodiment of a method for changing the lattice.

In order to change a lattice (i, j), for example, the lattice (i, j) is moved along a line connected with a neighboring lattice (i, j+1) or (i, j−1). Here, the change degree is limited to a range between the two neighboring lattices.

According to an exemplary embodiment of the present invention, when the lattice (i, j) being changed moves only by one-dimension, the range of change degree, which is only between the neighboring lattices, can be expanded.

For example, when lattices (i, j+2), (i, j+1), (i, j), (i, j−1) and (i, j−2) are to be changed as shown in FIG. 6, outermost lattices (i, j+2) and the (i, j−2) are moved first. In this case, the lattices are moved in order of (i, j+2) and (i, j−2), (i, j+1) and (i, j−1), and (i, j).

When the lattice (i, j+1) is moved to a position 'A' in a state that the outermost lattice (i, j+2) is already moved, the lattice (i, j) is able to move between its original position and the position 'A'.

Figure 7:
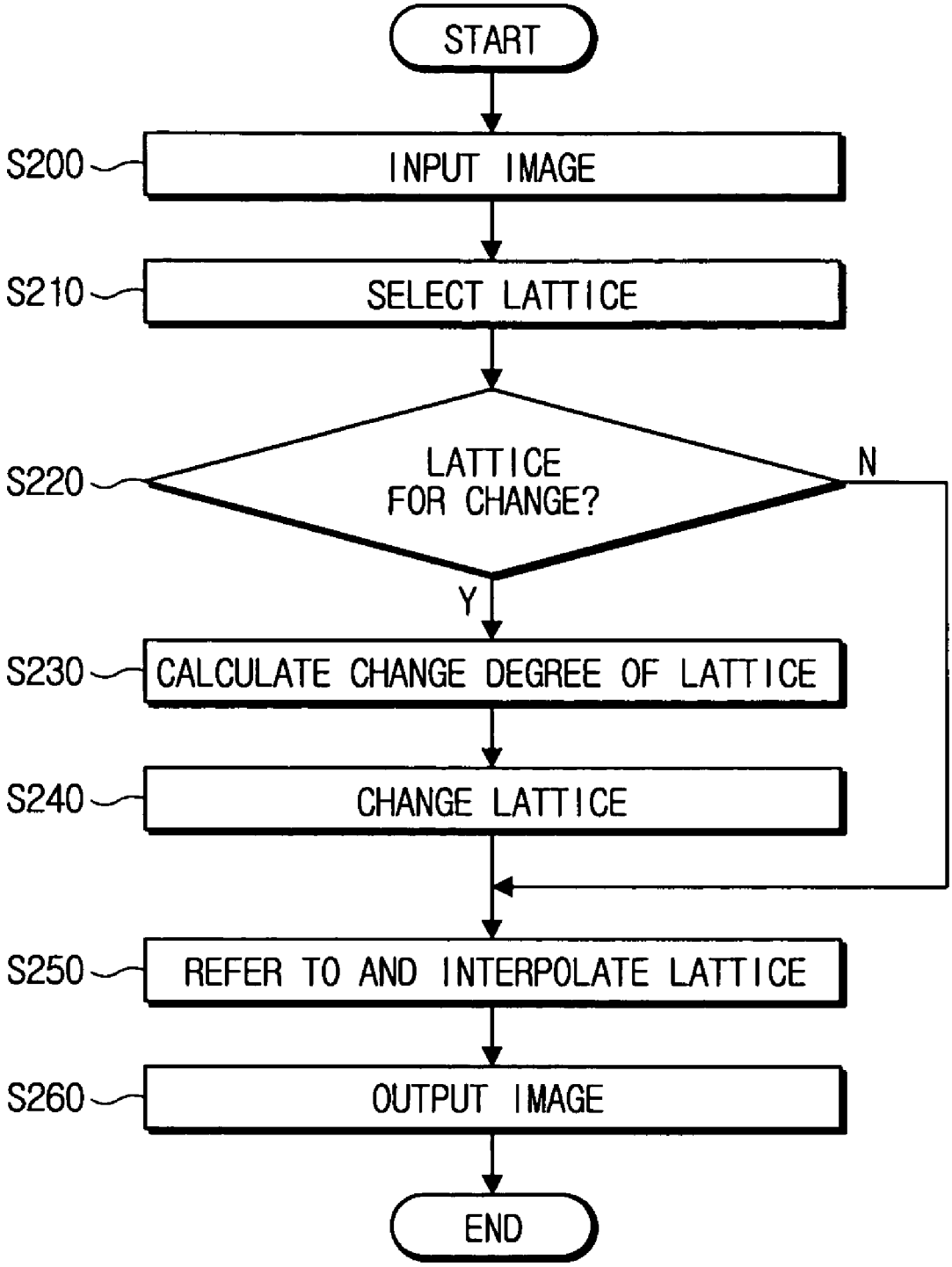
FIG. 7 is a flowchart for explaining a method for adjusting color in the image displaying device according to an exemplary embodiment of the present invention.

FIG. 7 is a flowchart for explaining a method for adjusting color in the image displaying device. The color adjusting method of the image displaying device 100 will now be described with reference to FIGS. 2 to 7.

Upon input of an image from a predetermined image source through the image input unit 110, the lattice selection unit 130 selects from the input image a lattice of the LUT that each pixel will refer to (S200 to S210).

As the lattice is selected by the lattice selection unit 130, the lattice control unit 140 determines the selected lattice requires change for color adjustment (S220). When adjusting one of the solid colors designated as lattices of the LUT, the lattice control unit 140 determines a lattice disposed between two solid colors neighboring the to-be-adjusted color as the lattice requiring change. When adjusting a middle color between two of the solid colors, the lattice control unit 140 determines a lattice to be changed, using proportion relations between the solid colors.

In operation S220, when the lattice selected by the lattice selection unit 130 is determined as the lattice requiring to be changed for color adjustment, the lattice control unit 140 calculates the change degree of the lattice (S230).

The lattice control unit 140 supplies the calculated change degree to the LUT conversion unit 150. The LUT conversion unit 150 changes the lattice based on the change degree as supplied from the lattice control unit 140, thereby updating the LUT (S240).

The lattice reference/interpolation unit 160 refers to or interpolates the lattice using the LUT updated by the LUT conversion unit 150 (S250), and the interpolated image is output through the image output unit 170 (S260).

In operation S220, if the lattice selected by the lattice selection unit 130 is determined to be not the to-be-changed lattice, the lattice control unit 140 refers to or interpolates the lattice through the lattice reference/interpolation unit 160 without changing the lattice (S250). Next, the image is output through the image output unit 170 (S260).

As can be appreciated from the above description about the image displaying device 100 and the method for controlling color thereof according to an exemplary embodiment of the present invention, since only the lattice requiring change and its neighboring lattices are considered for change by determining whether the lattice of the LUT for reference of each pixel requires to be converted. Therefore, the three-dimension LUT which has been used only for color compensation can be adjusted real time without demanding a dedicated hardware such as a memory.

Accordingly, color adjustment can be performed more accurately, thereby reducing image deflections generated between different types of image displaying devices and between the same type of image displaying devices.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image displaying device comprising:

a lattice selection unit which selects a lattice of a look-up table (LUT) for reference of each pixel of an input image;

a lattice control unit which determines whether the selected lattice is a lattice of which a position is to be changed for color adjustment using relations among solid colors in an RGB color space, each forming the same angle with one another, and calculates a change degree of a movement of the position of the lattice if the selected lattice is the lattice of which the position is to be changed for color adjustment;

an LUT conversion unit which converts the LUT by changing the lattice based on the calculated change degree of the movement of the position of the lattice; and a lattice reference or interpolation unit which refers to or interpolates the lattice based on the converted LUT, wherein the lattice control unit determines a lattice disposed between two solid colors neighboring the solid color to be adjusted as a lattice requiring change, when adjusting one of the solid colors; and wherein the lattice control unit calculates the change degree of the movement of the position of the lattice within a distance range between the lattice to be changed and neighboring lattices.

2. The image displaying device of claim 1, wherein solid colors for lattices of the LUT comprise red, green, blue, cyan, magenta and yellow.

3. The image displaying device of claim 2, wherein, in order to adjust a middle color between two of the solid colors, the lattice control unit determines a lattice to be changed, using proportion relations between the solid colors.

4. The image displaying device of claim 3, wherein the lattice to be changed is the lattice corresponding to a position value obtained by subtracting a position value of the middle color from position values of the solid colors disposed respectively outside of the two solid colors.

5. The image displaying device of claim 1, further comprising a user input unit which inputs a color requiring change.

6. A method for controlling color in an image displaying device, the method comprising:

selecting a lattice in a look-up table (LUT) for reference of each pixel of an input image;

determining whether the selected lattice is a lattice of which a position is to be changed for color adjustment using relations among solid colors in an RGB color space, each forming the same angle with one another;

calculating a change degree of the movement of the position of the lattice, if the selected lattice is the lattice of which the position is to be changed for color adjustment;

converting the LUT by changing the lattice based on the calculated change degree of the movement of the lattice; and referring to or interpolating the lattice based on the converted LUT, wherein in the determining whether the selected lattice is to be changed for color adjustment, a lattice disposed between two solid colors neighboring the solid color to be adjusted is determined as a lattice to be changed, when adjusting one of the solid colors; and wherein the calculating change degree of the movement of the position of the lattice comprises calculating the change degree within a distance range between the lattice to be changed and neighboring lattices.

7. The method of claim 6, wherein solid colors for lattices of the LUT comprise red, green, blue, cyan, magenta and yellow.

8. The method of claim 7, wherein, in the determining whether the selected lattice is to be changed for color adjustment, in order to adjust a middle color between two of the solid colors, a lattice to be changed is determined using proportion relations between the solid colors.

9. The method of claim 8, wherein the lattice to be changed is the lattice corresponding to a position value obtained by subtracting a position value of the middle color from position values of the solid colors disposed respectively outside of the two solid colors.

10. The method of claim 6, further comprising inputting a color requiring change and determining whether a lattice corresponding to the input color is to be changed.

* * * * *